US008720664B2

(12) United States Patent
Anouar et al.

(10) Patent No.: US 8,720,664 B2
(45) Date of Patent: May 13, 2014

(54) APPARATUS AND METHOD FOR CHARACTERIZING ITEMS OF CURRENCY

(71) Applicant: MEI, Inc., Malvern, PA (US)

(72) Inventors: Fatiha Anouar, Glenmoore, PA (US); Gaston Baudat, Glenmoore, PA (US)

(73) Assignee: MEI, Inc., Malvern, PA (US)

( * ) Notice: Subject to any disclaimer, the term of this patent is extended or adjusted under 35 U.S.C. 154(b) by 0 days.

(21) Appl. No.: 13/756,628

(22) Filed: Feb. 1, 2013

(65) Prior Publication Data

US 2013/0199889 A1 Aug. 8, 2013

Related U.S. Application Data

(60) Provisional application No. 61/594,428, filed on Feb. 3, 2012.

(51) Int. Cl.

| | |
|---|---|
| ***G07F 7/04*** | (2006.01) |
| ***G07D 7/12*** | (2006.01) |
| ***G07D 7/20*** | (2006.01) |

(52) U.S. Cl.

CPC ..... *G07D 7/122* (2013.01); *G07D 7/205* (2013.01)

USPC ..... 194/207; 382/135

(58) Field of Classification Search

CPC ..... G07D 7/20; G07D 7/12; G07D 7/04; G07D 7/00; G07D 7/205; G07D 7/122; G07D 11/0081; G07D 11/0084; G07F 7/04; G07F 19/20; B65H 2701/1912

USPC ..... 194/206, 207; 209/534; 382/135

See application file for complete search history.

(56) References Cited

U.S. PATENT DOCUMENTS

| | | | | |
|---|---|---|---|---|
| 8,401,268 | B1 * | 3/2013 | Yacoubian et al. | 382/135 |
| 2002/0159615 | A1 * | 10/2002 | Rhoads et al. | 382/100 |
| 2003/0231785 | A1 * | 12/2003 | Rhoads et al. | 382/100 |
| 2007/0291491 | A1 * | 12/2007 | Li et al. | 362/307 |
| 2009/0316030 | A1 * | 12/2009 | Dai | 348/300 |
| 2010/0177906 | A1 * | 7/2010 | Vetterli et al. | 381/74 |
| 2012/0075493 | A1 * | 3/2012 | Singh et al. | 348/222.1 |

OTHER PUBLICATIONS

Mallat and Zhang, Matching Pursuits with Time-Frequency Dictionaries, IEEE Transactions on Signal Processing, vol. 41, No. 12, Dec. 1993, is cited as disclosing time frequency dictionaries and greedy algorithms, pp. 3397-3415.*

* cited by examiner

*Primary Examiner* — Jeffrey Shapiro

(74) *Attorney, Agent, or Firm* — Mintz Levin Cohn Ferris Glovsky and Popeo, P.C.

(57) ABSTRACT

In one aspect, a validation apparatus comprises a light source capable of emitting a broadband spectrum of light for illuminating an item of currency. The validation apparatus also includes a receiver configured to receive light emitted from the light source. In another aspect, the validation apparatus also includes a transportation unit configured to transport the item of currency within the validation apparatus. In a further aspect, the validation apparatus also includes a processor configured to reconstruct a spectral response of the item of current. In this design, the light received by the receiver comprises at least a portion of light reflected by or transmitted through the item of currency.

39 Claims, 16 Drawing Sheets

APPARATUS AND METHOD FOR CHARACTERIZING ITEMS OF CURRENCY

RELATED APPLICATIONS

This application claims priority to U.S. provisional application Ser. No. 61/594,428, filed Feb. 3, 2012, which is incorporated by reference herein in its entirety.

FIELD OF DISCLOSURE

This disclosure relates to an apparatus and methods of characterizing items of currency. More particularly, this disclosure relates to an apparatus for and methods of using compressive sensing technologies to characterize items of currency, particularly employing a broadband light source.

BACKGROUND

Many devices can be used to characterize items of currency. For example, a validation device, comprising a validation unit, can be used to characterize an item of currency.

For the purposes of the disclosure, the term currency and/or item of currency includes, but is not limited to, valuable papers, security documents, banknotes, checks, bills, certificates, credit cards, debit cards, money cards, gift cards, coupons, coins, tokens, and identification papers.

In such state of the art devices the validation unit includes a sensing module often further comprising a source for emitting light and a receiver for receiving the emitted light. Validation of an item of currency can involve the measurement and analysis of one or both of reflected light and light transmitted through a currency item. Additionally, validation can include, but is not limited to, type detection, denomination, validation, authentication and document condition determination.

Some validation units are arranged to use a plurality of light emitting sources (e.g., Light Emitting Diodes (LEDs)) to gather reflective and/or transmission responses from a currency item. Generally these sources are configured such that they emit light within a relatively narrow band of wavelength within a spectrum. More particularly, commonly known sources (e.g., red LEOs, blue LEOs, or green LEOs) typically have an emission spectrum with a narrow bandwidth (e.g., between 15 nm and 35 nm). Examples of common sources can include red sources emitting light in the range of 640 nm to 700 nm, blue sources emitting light in the range of 450 nm to 480 nm, or green sources emitting light in the range of 520 nm to 555 nm. Often such common sources are configured to emit light within wavelength bands consistent with known colors within the visible spectrum (e.g., red light, blue light and green light). The spectral response of a currency item to being illuminated with sources having emission within known color spectrums of visible light can be used to determine various characteristics about the item of currency. In some cases, non-visible light (e.g. infrared, or UV) can be used to gather information about characteristics of an item of currency.

One of the limitations of such a validation unit is that the combination of narrow bandwidth spectrums that are emitted by each individual source may generally result in gaps across the overall spectrum of interest. While it is possible to use a very large number of narrow band sources to cover the overall spectrum of interest, such an approach is undesirable because it could lead to a very large, expensive, and unreliable validation apparatus. Moreover, applying such an approach may increase the frequency of field upgrades to the validation unit hardware to the extent that it becomes desirable to broaden the spectrum of interest after the validation unit has already been deployed to the end-user. In addition, such a solution could result in a device required to process very large amounts of data and thus is not as efficient as required for a currency validation apparatus (e.g., gaming machine, vending, machine, and ticketing machine, etc.) where the validation time interval is critical (e.g., less than one second).

Other image processing machines (e.g., document scanners or photocopiers) use a plurality of sources and detectors to reproduce or store an image of a document. Such image processing machines operate in a way that is analogous to the human eye in the sense that the image processing machine averages the component colors of the document. Thus, similar to the human eye, such image processing machines cannot distinguish between the original document, and the reproduced document image. Such imaging systems can have a high spatial resolution, however the spectral resolution is limited.

Therefore, there exists a need for more efficient, high-performance, reliable, and/or cheaper validation unit.

SUMMARY

In one aspect, a validation apparatus comprises a light source capable of emitting a broadband spectrum of light for illuminating an item of currency. The validation apparatus also includes a receiver configured to receive light emitted from the light source. In another aspect which may be used in combination with the above aspect, the validation apparatus also includes a transportation unit configured to transport the item of currency within the validation apparatus. In a further aspect which may be used in combination with the above aspects, the validation apparatus also includes a processor configured to reconstruct a spectral response of the item of current. In this design, the light received by the receiver comprises at least a portion of light reflected by or transmitted through the item of currency.

In some implementations of any of the above aspects, the validation apparatus can comprise stored classification variables. Optionally, the light source can emit light in the visible and nonvisible light spectrum.

In some embodiments of any of the above aspects, the receiver can comprise a broadband photodetector and an optical filter array coupled to the photodetector. In this design, the optical filter array may comprise a plurality of optical filters configured to filter light at different wavelengths. In one aspect which may be used in combination with any of the above aspects, the processor may be configured to selectively control an optical filter for coupling with the photodetector.

In some implementations which may also be applied in combination with the above aspects, the receiver can comprise a plurality of broadband photodetectors, wherein each photo detector is configured to filter light at different wavelengths. In some designs of any of the above aspects, the light source can comprise a plurality of light emitting diodes configured to emit light at different wavelengths. Optionally, the different wavelengths are linearly independent. In other aspects which may be used in combination with any of the above aspects, the light-emitting diode wavelengths can be selected to minimize a coherence.

In some designs which may be used in combination with any of the above aspects, the plurality of light emitting diodes can comprise a blue LED, wherein phosphors are used to control a spectral emission of the blue LED. In some implementations, the plurality of light emitting diodes can additionally or alternatively comprise an ultraviolet LED, wherein phosphors are used to control a spectral emission of the ultraviolet LED. In other implementations, the plurality of light emitting diodes can additionally or alternatively comprise an infrared LED. In certain implementations, the light source can comprise at least three light emitting diodes configured to emit light at different wavelengths. In other implementations, the light source can comprise at least six light emitting diodes configured to emit light at different wavelengths.

In one aspect which may be used in combination with any of the above aspects, the processor can be further configured to control each of the plurality of light emitting diodes independently. In another aspect which may be used in combination with the above aspect, each of the plurality of light emitting diodes can be energized in a predetermined manner.

In some implementations of any of the above aspects, the validation apparatus can comprise a stored L1-minimization algorithm (See, for example, *L1 minimization* R. Tibshirani, "Regression shrinkage and selection via the lasso," *J. Roy. Stat. Soc. Ser. B*, vol. 58, no. 1, pp. 267-288, 1996). In this design, the L 1-minimization algorithm can optionally comprise a greedy algorithm (See, for example, *Greedy algorithms* J. A. Tropp and A. C. Gilbert. "Signal recovery from random measurements via orthogonal matching pursuit." IEEE Trans. on Info. Theory, 53(12):4655-4666, 2007). In another aspect which may be used in combination with any of the above aspects, the validation apparatus can comprise a stored representation matrix, wherein the representation matrix is used to transition between a non-sparse function space to a sparse function space. In this design, the processor can be further configured to apply acceptance criteria to the reconstructed spectral response to determine whether the item of currency falls within a predetermined classification of currency. In one aspect which may be used in combination with any of the above aspects, the spectral response is reconstructed based upon the stored representation matrix and the plurality of measurements. In some implementations of any of the above aspects, the representation matrix comprises a learned dictionary.

In another aspect, a method of validating an item of currency is disclosed herein. The method can include the steps of transporting the item of currency within the validation apparatus, emitting a broadband spectrum of light to illuminate an item of currency, receiving at least a portion of the light reflected by or transmitted through the item of currency emitted from the light source, and reconstructing via a processor a spectral response of the item of currency.

In some implementations which may be used in combination with the above aspect, the light can be emitted in the visible and/or nonvisible light spectrum. In certain aspects which may be used in combination with any of the above aspects, the receiver can comprise a broadband photodetector and an optical filter array coupled to the photo detector. In some designs, the optical filter array may comprise a plurality of optical filters configured to filter light at different wavelengths. In some implementations of any of the above aspects, the processor may be configured to selectively control an optical filter for coupling with the photodetector.

In some aspects which may be used in combination with any of the above aspects, the method of validating an item of currency can also include the step of storing a L1-minimization algorithm. In some implementations of any of the above aspects, the method can also include the step of storing classification variables.

In some designs of any of the above aspects, the light is emitted using a light source comprising a plurality of light emitting diodes configured to emit light at different wavelengths. In one aspect, the different wavelengths can be linearly independent. In another aspect which may also be applied in combination with any of the above aspects, the light emitting diodes can be selected to minimize a coherence with the representation space. In certain aspects which may be used in combination with any of the above aspects, the plurality of light emitting diodes can comprise a blue LED, wherein phosphors are used to control a spectral emission of the blue LED. In other aspects which may be used in combination with the above aspect, the plurality of light emitting diodes can additionally or alternatively comprise an ultraviolet LED, wherein phosphors are used to control a spectral emission of the ultraviolet LED. In further aspects which may be used in combination with the above aspect, the plurality of light emitting diodes can additionally or alternatively comprise an infrared LED.

In some implementations of any of the above aspects, the plurality of light emitting diodes can include at least three light emitting diodes. In other implementations of any of the above aspects, the plurality of light emitting diodes can include at least six light emitting diodes. In one aspect which may be used in combination with any of the above aspects, the processor can be configured to carry out the step of controlling each of the plurality of light emitting diodes independently. In other aspects which may be used in combination with any of the above aspects, each of the plurality of light emitting diodes can be energized in a predetermined manner.

In some designs of any combination of the above aspects, a step of storing a representation matrix that may be used to transition from a non-sparse function space to a sparse function space can also be included. Sparsity expresses the idea that the information rate of a signal may be much smaller than suggested by its bandwidth. Many signals of N coefficients can be represented in another space (called representation space) where only S coefficients are non-zeros where $S \ll N$, the signal is then said to be S-sparse. The original signal with N non-zeros coefficients is said to be non sparse at the opposite of its new representation where only S coefficients are non-zeros. Optionally, the processor can be further configured to carry out the step of applying acceptance criteria to the reconstructed spectral response to determine whether the item of currency falls within a predetermined classification of currency. In one aspect which may be used in combination with the above aspects, the spectral response is reconstructed based upon the stored representation matrix and the plurality of measurements. In some implementations of any of the above aspects, the representation matrix can comprise a learned dictionary.

These and other features of the invention are described in detail below.

DETAILED DESCRIPTION

A low-cost and high spectral resolution currency validation apparatus and methods are disclosed herein. In one aspect, the currency validation apparatus includes a sensing unit configured to enhance spectral resolution using a specified light source (or specified detection unit) in combination with advanced processing such as compressive sensing (See, for example, *Compressive sensing* E. Candès, J. Romberg, and T. Tao, "Robust uncertainty principles: Exact signal reconstruction from highly incomplete frequency information," *IEEE Trans. Inform. Theory*, vol. 52, no. 2, pp. 489-509, February 2006. E. Candès and M. Wakin, An introduction to compressive sampling. IEEE Signal Processing Magazine, vol. 25(2), pp. 21-30, March 2008) techniques. In another aspect which may be used in combination with the above aspect, the currency validation apparatus can perform compressive sensing techniques to reconstruct a high-resolution spectral response of an item of currency using a broadband light source, such as a plurality of LEDs coated with phosphors. Although custom LEDs and/or custom phosphors may be used, they are not necessary in accordance with some embodiments. In some embodiments, off-the shelf, commercially available phosphors may be used with standard LEDs. In further aspects which may be used in combination with any of the above aspects, the currency validation apparatus can perform compressive sensing techniques to reconstruct a spectral response of the item of currency using a broadband light source and a plurality of receiver filters coated with off-the-shelf phosphors, themselves operatively coupled to at least one detection sensor. Compressive sensing of the item of currency spectral response using a broadband light source can facilitate the low-cost validation of an item of currency at an enhanced spectral resolution.

As used in this disclosure, a broadband spectrum refers to an emission spectrum having relatively constant intensity across either the full spectrum (e.g. visible and/or non-visible) or a relatively constant intensity across a relatively broad bandwidth (e.g. 100 nm, 200 nm, 500 nm, 1 μm, 10 μm, 100 μm, 1 mm).

Figure 1:
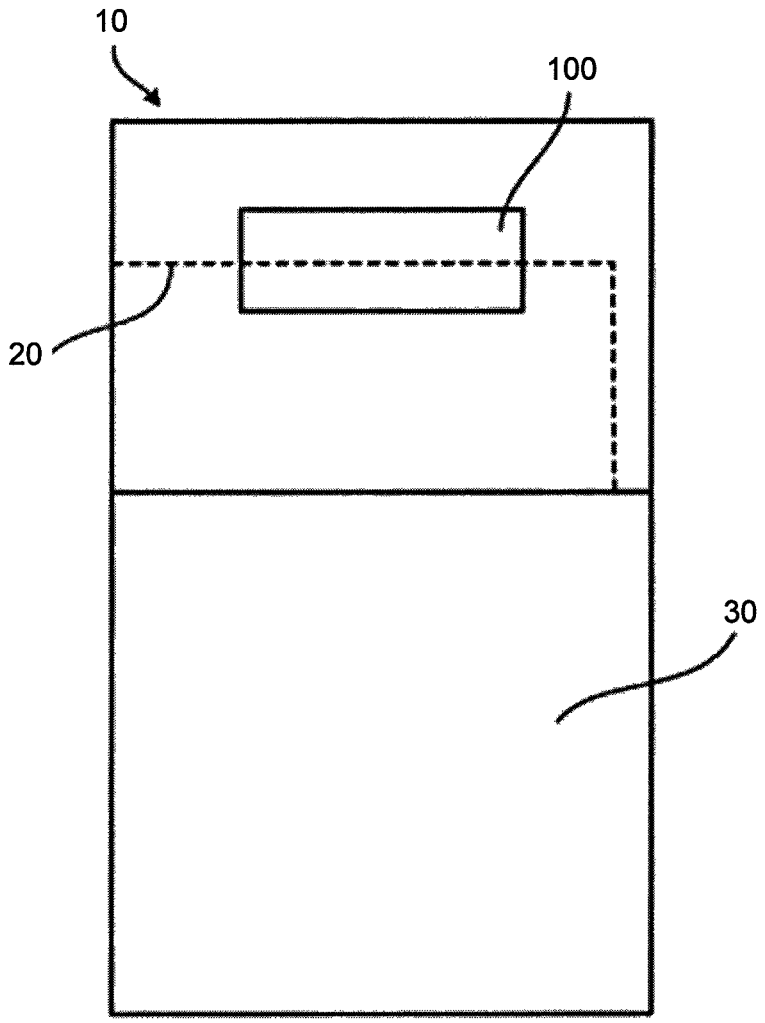
FIG. 1 is a schematic view of a validation unit.

In some implementations, as shown in FIG. 1, a validation unit 10 can include a sensor module 100, a currency item store 30, a transport unit 20, and a processor (not shown). In this design, the processor is configured to control the sensor module 100, currency item store 30, and transportation unit 20 to validate currency items (not shown) inserted therein, and to transport the currency items from the validation unit 10, through the sensor module 100, and into the store 30 in the case of an acceptable item of currency.

Figure 2:
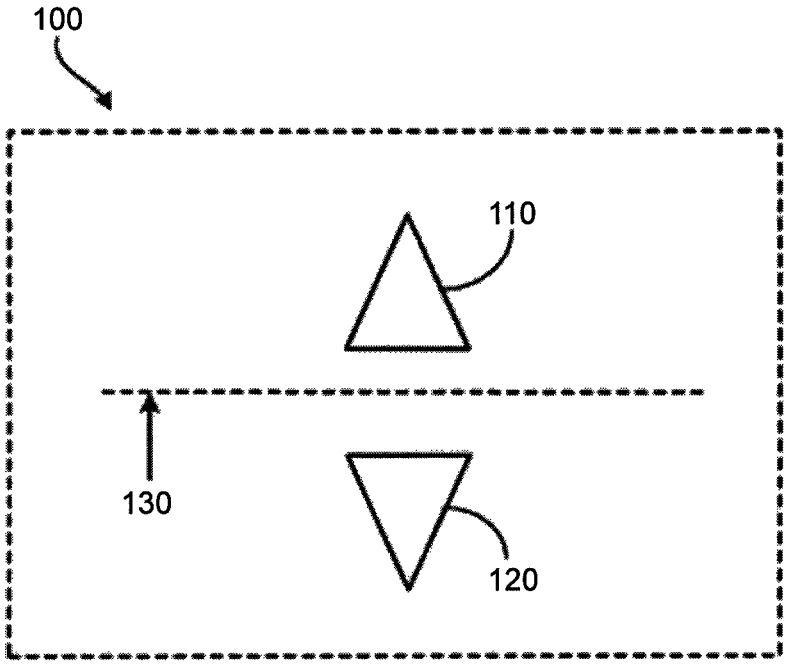
FIG. 2 is a schematic view of a sensor module.

In some embodiments, as shown in FIG. 2, the sensor module 100 can comprise a broadband light source 110 and a receiver 120. In some implementations, the processor is configured to reconstruct a spectral response of the item of currency 130, which is transported to and through the validation unit 10 via the transport unit 20. The reconstructed spectral response is based upon the received measurement and a stored basis.

As used herein, a basis is a representation matrix for transition between a non-sparse function space and a sparse function space. In certain implementations, a dictionary is implemented. A dictionary is a learned basis.

The processor is further configured to apply acceptance criteria by which the item of currency can either be accepted or not, in view of the reconstructed spectral response. Acceptance criteria can be an analysis process including, but not limited to, Malahanobis distance (Malahanobis distance is known distance measure developed by P. C. Malahanobis in 1936 and is well described in the literature, for example, Hazewinkel, Michael, ed. (2001) "Mahalanobis distance", Encyclopedia of Mathematics, Springer, ISBN 978-1-55608-010-4), Support Vector Machine (Support Vector Algorithm or Machine (SVM): well described in the literature but also described in patent application US2009/0307167 A1 and U.S. Pat. No. 7,648,016. See also, V. Vapnik. *Statistical Learning Theory*. John Wiley and Sons, Inc., New York, 1998), or any other process by which at least two items of currency are evaluated to classify known and unknown items of currency. However, one skilled in the art would understand that other criteria can be used to determine whether or not a bill cab be accepted such as but not limited to dimensional characteristics.

In some embodiments, the light source 110 is capable of emitting a broadband spectrum of light for illuminating an item of currency 130. In one implementation, the light source 110 can emit light in the visible spectrum, non-visible spectrum, or any combination thereof. In one aspect, the receiver 120 is configured to receive at least a portion of the light emitted by the light source 110 and reflected by or transmitted through the item of currency 130. The transportation unit (not shown) is configured to transport the item of currency within the validation apparatus. The processor (not shown) can be configured obtain spectral measurements Y, such as the light reflected by or transmitted through spots along the item of currency 130, and further configured to reconstruct a high resolution spectrum Z of the item of currency 130 based upon the spectral measurements Y.

In further aspects which may be used in combination with any of the above aspects, the processor can be configured to apply acceptance criteria to the high-resolution spectrum Z to determine whether the item of currency 130 falls within a predetermined classification of currency. In one implementation, the processor can be configured to evaluate each predetermined evaluation spot based on the whole group of possibly valid items of currency accepted by the validation unit 10. It is to be understood that a predetermined classification of currency can include authentic items of currency, known non-authentic (e.g. counterfeit) items of currency, and unknown non-authentic items of currency.

However, it should be understood that the processor can be configured to apply acceptance criteria in many different ways. For example, the processor can be configured to pre-classify the item of currency 130, by determining the type of currency (e.g. denomination). While in one embodiment, the processor can be configured to pre-classifying the item of currency 130 prior to reconstructing a high resolution spectrum Z, it is to be understood that the processor can also be configured to pre-classify the item of currency 130 in parallel with other processes, such as, but not limited to accessing memory, algorithm initialization, computations, reconstruction of the high resolution spectrum, classification, or any combination thereof. In further aspects which may be used in combination with any of the above aspects, the acceptance criteria can be applied to reject the item of currency 130 to the extent that the item of currency 130 does not fall within any known classification. However, it is to be understood that in certain implementations, the acceptance criteria can be applied to accept the item of currency 130 to that extent that it is determined that the item of currency is an unknown non-authentic (e.g., counterfeit) item of currency, which warrants further evaluation. It shall also be understood that known items of currency can include both authentic and non-authentic (e.g. forgeries) currency.

Figure 3:
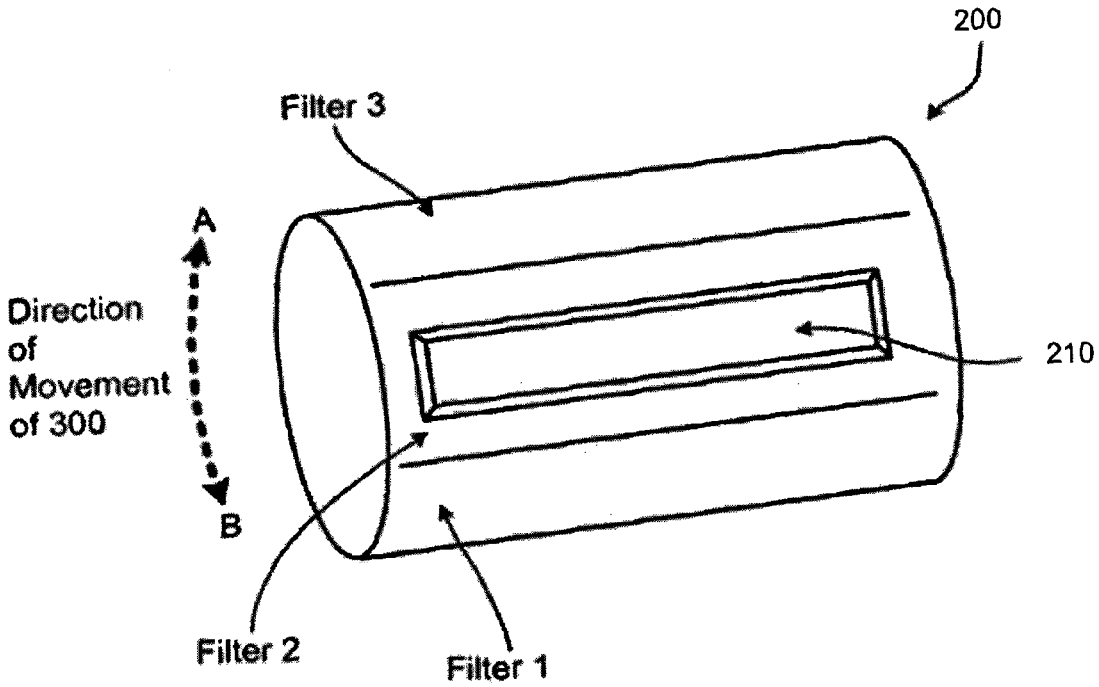
FIG. 3 is a perspective view of an exemplary filter wheel.

In one implementation, as shown in FIGS. 2 and 3, the validation unit 10 can further comprise an optical filter array 200 optically coupled to the receiver 120. In some designs, the optical filter array 200 includes a plurality of optical filters 210, and the processor is configured to control the selection of the optical filter 210 for coupling with the receiver 120. In some embodiments, the receiver 120 can comprise a photodetector. However, it is to be understood that the receiver 120 can also comprise a plurality of photodetectors, wherein each photodetector is coupled to an optical filter.

In one aspect which may be used in combination with any of the above aspects, the validation unit 10 can further comprise a storage device that stores the basis (i.e. representation matrix) that is used to transform the spectral measurements Y into a sparse spectrum signal Θ. The validation unit 10 can also be configured to store a L1-minimization algorithm (e.g. a greedy algorithm such as matching pursuit) used by the processor during the transformation of the spectral measurements Y into the sparse spectrum signal Θ. For example, the processor can be configured to store an L1-minimization algorithm which finds the sparse spectrum signal Θ that reconstructs the optimal spectrum X, based upon the known spectral measurements Y and sensing matrix $\Phi=(\perp_l, \ldots, \perp_m)$, according to the following equation:

$$\min_{\Theta} \|\Theta\|_{L_1} \quad s.t. \quad y=\Phi x \qquad \text{(equation 1)}$$

In another aspect which may be used in combination with any of the above aspects, the processor can also be configured to reconstruct the high resolution spectrum Z by solving for the dot product of the representation matrix (e.g. learned dictionary) and the sparse spectrum signal Θ. In further aspects which may also be used in combination with any of the above aspects, the validation unit 10 can be configured to store a subset of classification variables W (for each item of currency validated), which are used to classify the item of currency 130.

The basis, L1-minimization algorithm, subset of variables W, or any combination thereof can be stored in one or more memory devices coupled to the processor. However, a person of ordinary skill would understand that any storage technology can be used for storage, such as but not limited to, remote servers, hard drives, solid state drives, magnetic tape drives, or any combination thereof.

In order to validate an item of currency 130 in a validation apparatus 10 using compressive sensing techniques the following steps can be performed. Certain information and algorithms can be stored or loaded into validation apparatus 10. As will be described in later sections of the disclosure, such information and/or algorithms can be obtained in the laboratory, manufacturing facility or other location. In some implementations, as shown in in steps 310 through 370 of FIG. 4, a basis (i.e. representation matrix), a L1-minimization algorithm, and a subset of classification variables W (for each banknote to be validated) can be stored in memory (not shown) of a validation apparatus 10. In some embodiments, the basis can comprise a dictionary D.

Figure 5:
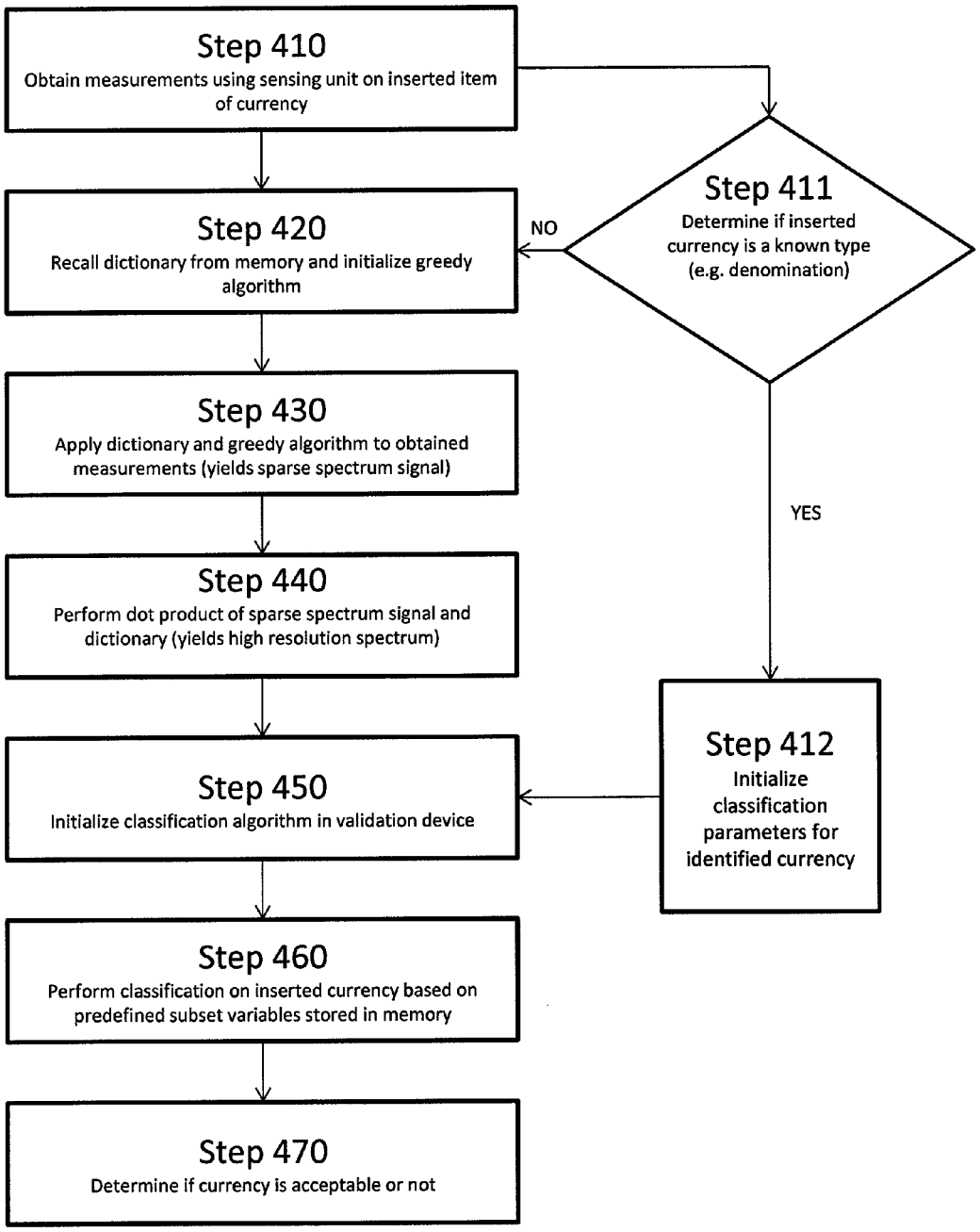
FIG. 5 is a flowchart illustrating the validation of an item of currency according to an embodiment.

With reference to FIG. 5, upon insertion of an item of currency 130 into the validation apparatus 10, the item of currency 130 is transported to validation sensors, which obtain spectral measurements Y of the inserted item of currency 130. The obtained spectral measurements Y can comprise light reflected by or light transmitted through the item of currency 130 using a sensor module 100 as shown in Step 410. In step 420, the validation apparatus 10 recalls a basis, such as dictionary D, from a storage device, and initializes a stored L1-minimization algorithm. In step 430, the dictionary D in conjunction with the L1-minimization algorithm is applied to the spectral measurements Y to calculate a sparse spectrum signal Θ. In step 440, the dot product of the dictionary D and the sparse spectrum signal Θ is calculated to obtain a high resolution spectrum Z of the item of currency 130. In step 450 a classification algorithm is initialized in the validation apparatus 10. In step 460, the inserted item of currency is classified using the subset of classification variables W. In this operation, the validation apparatus 10 evaluates each predetermined evaluation spot based upon the whole group of possible valid items of currency accepted by the validation unit 10.

Figure 12:
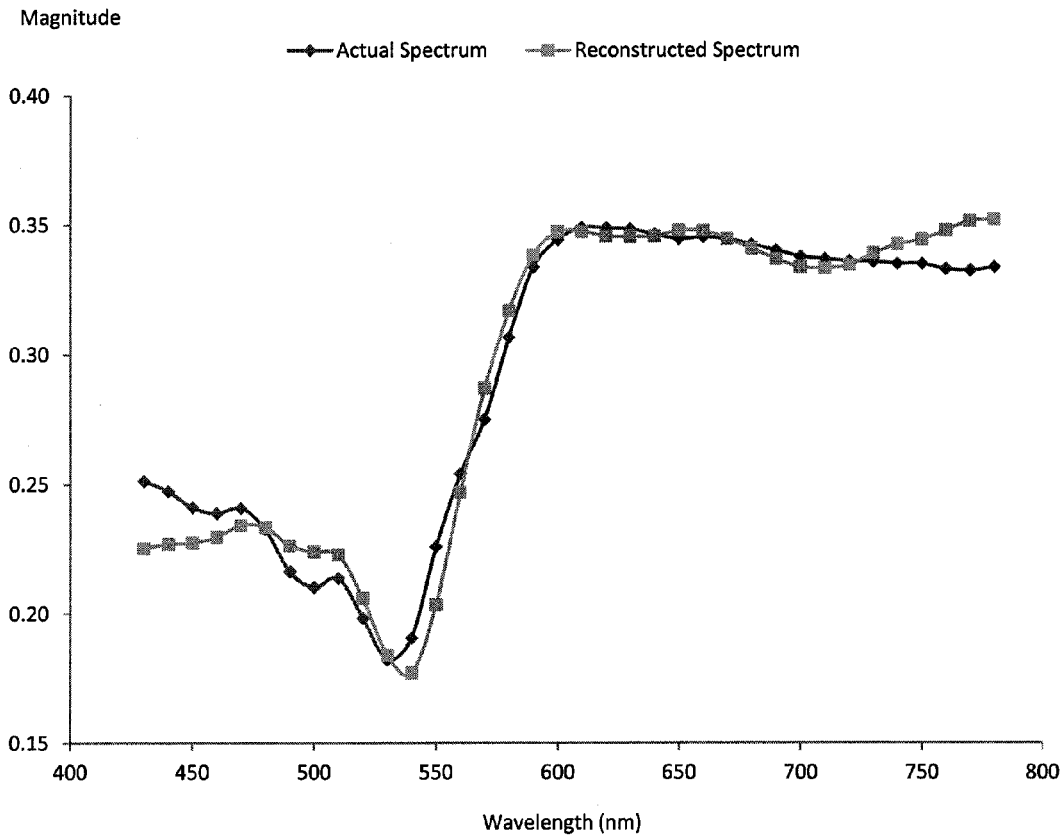
FIG. 12 is a chart illustrating the tracking of the item of currency actual spectrum by the reconstructed spectrum.
Figure 13:
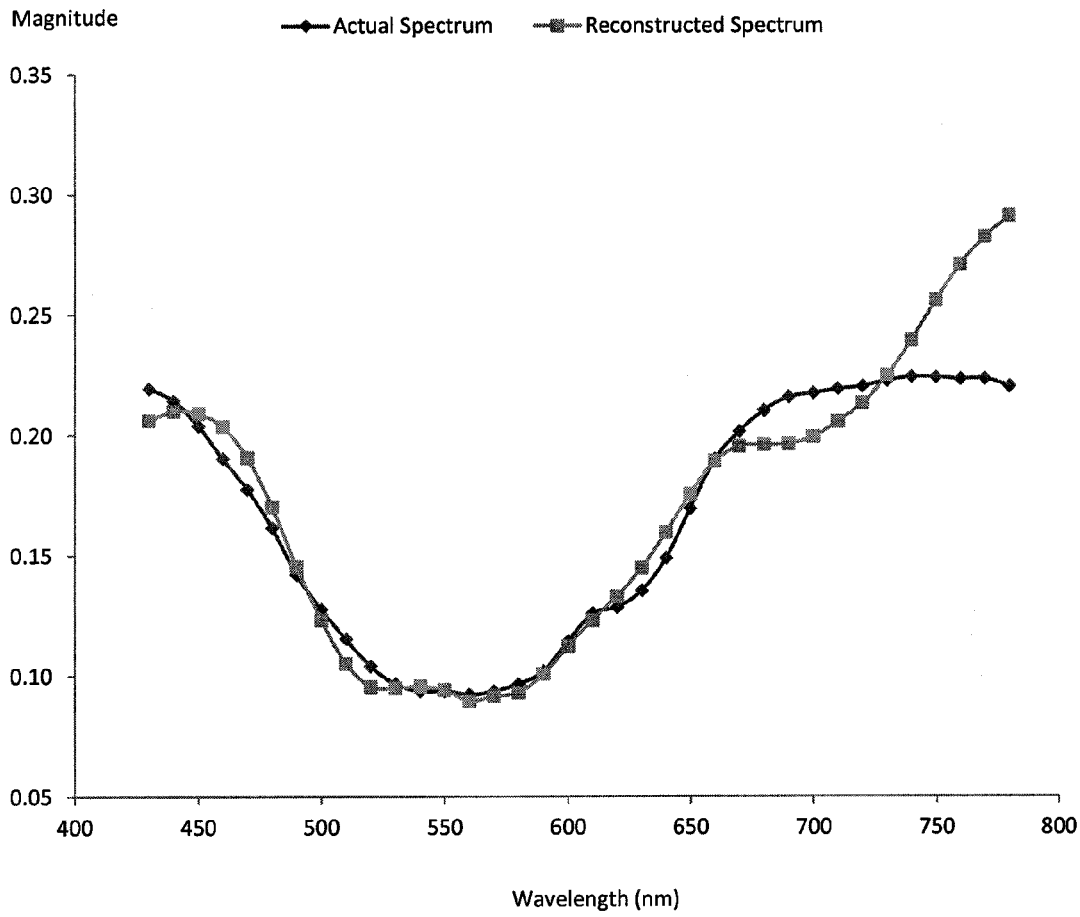
FIG. 13 is a chart illustrating the tracking of the item of currency actual spectrum by the reconstructed spectrum.
Figure 14:
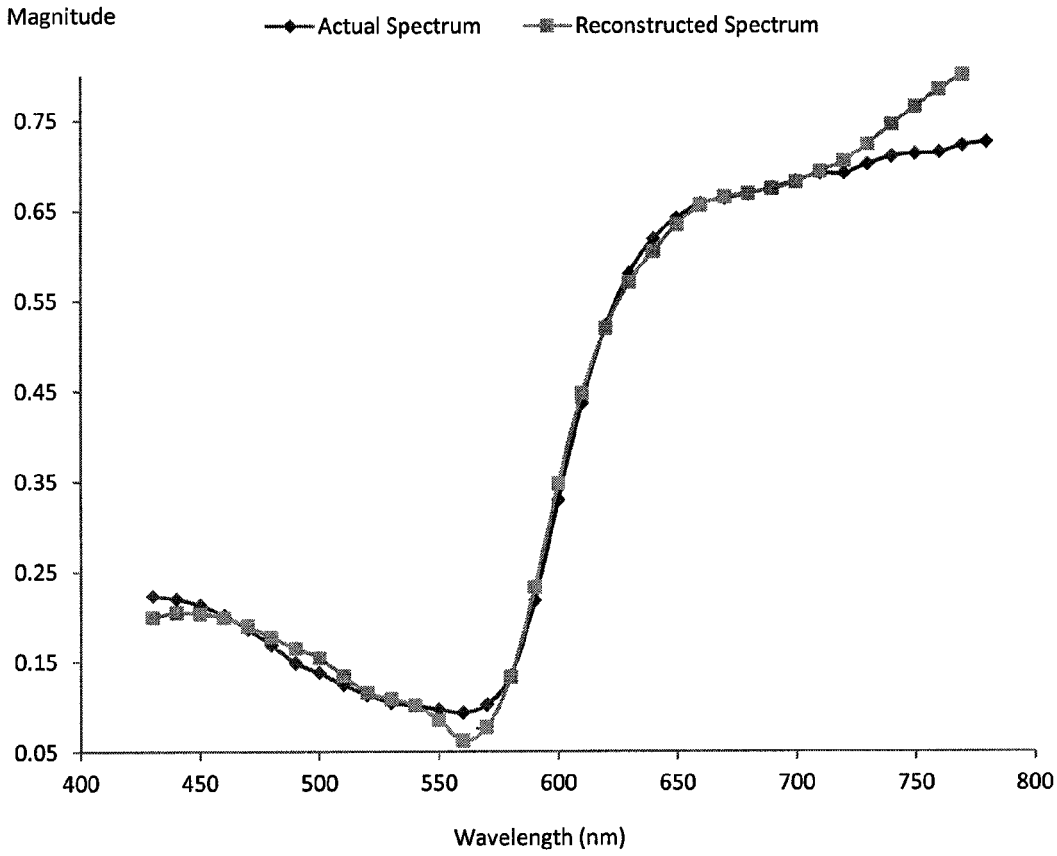
FIG. 14 is a chart illustrating the tracking of the item of currency actual spectrum by the reconstructed spectrum.

Referring to FIGS. 12-14, the tracking of the actual spectrum by the reconstructed spectrum high-resolution spectrum is shown.

In some implementations, referring back to FIG. 5, the validation apparatus 10 can be configured to determine the type of currency inserted (e.g. denomination) prior to performing steps 420-440. This can allow for a more efficient classification process as only the subset of classification variables W for the identified item of currency 130 that was inserted needs to be evaluated during classification. For example, in step 411 validation apparatus 10 determines if the inserted item of currency 130 is of a known type. If the result of step 411 is yes, validation apparatus 10 initializes only the classification variable W for the identified item of currency 130. If the result of step 411 is no, validation apparatus 10 does not initialize a specific subset classification variables Wand operates as described previously.

Figure 6:
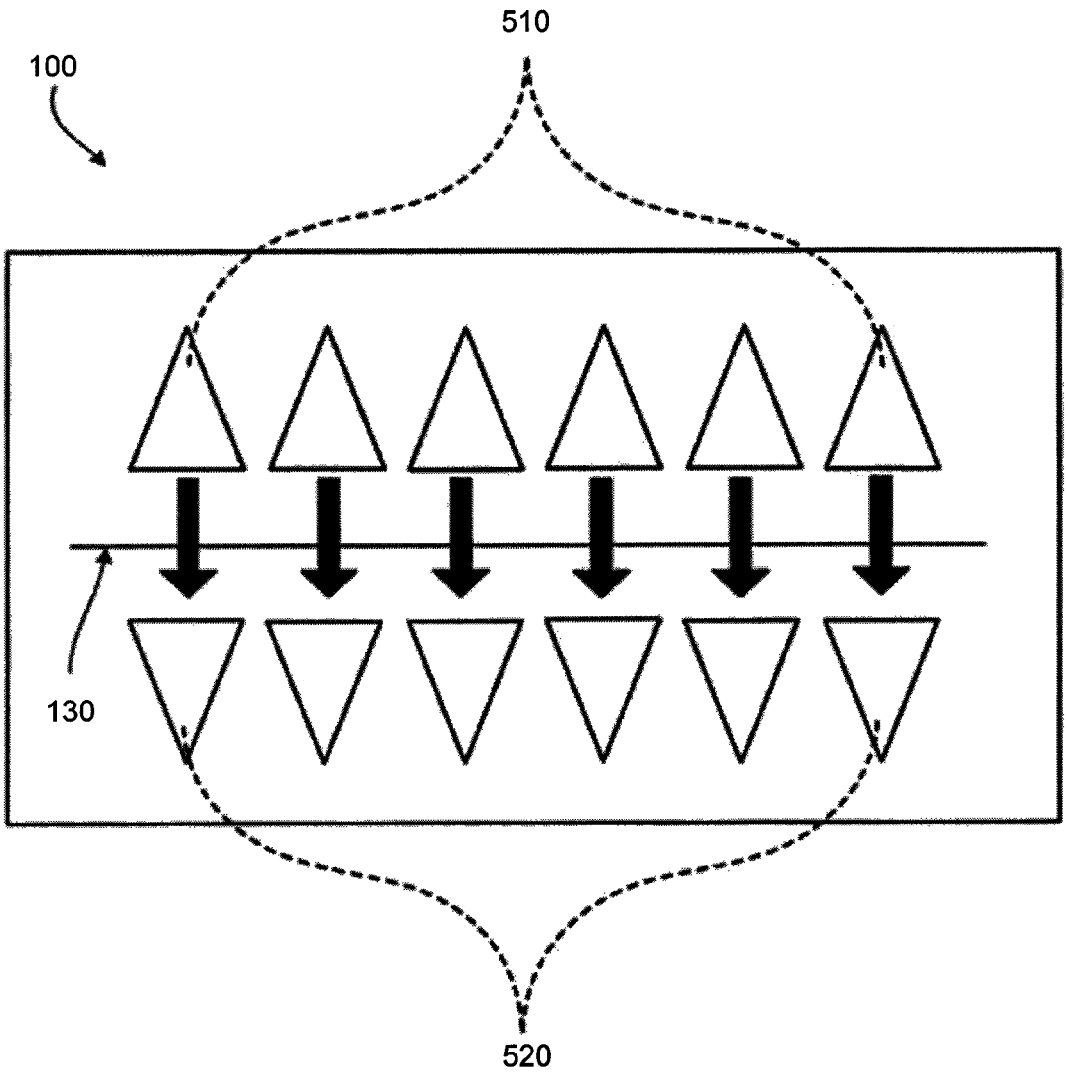
FIG. 6 is a schematic view of the sensor module according to an embodiment.

In some embodiments, as shown in FIG. 6, the sensor module 100 can include a light source 510, itself comprising a plurality of light emitting diodes configured to emit light at different wavelengths. In some embodiments, the plurality of LEDs can comprise blue LEDs, ultraviolet LEDs, infrared LEDs, or any combination thereof. In some embodiments, the LEDs can comprise blue LEDs or ultraviolet LEDs or combinations thereof. In some embodiments, the LEDs can comprise blue LEDs. In some embodiments, the plurality of LEDs can comprise off-the-shelf LEDs, however it should be understood that the plurality of LEDs can comprise custom LEDs, off-the-shelf LEDs, or any combination thereof. Some or all of the LEDs can be doped with phosphors to shift the spectral content of the emitted light, and to provide the desired spectral coverage. In other aspects which may be used in combination of any of the above aspects, the plurality of LEDs can be doped with off-the-shelf phosphors, custom phosphors, or any combination thereof.

Figure 7:
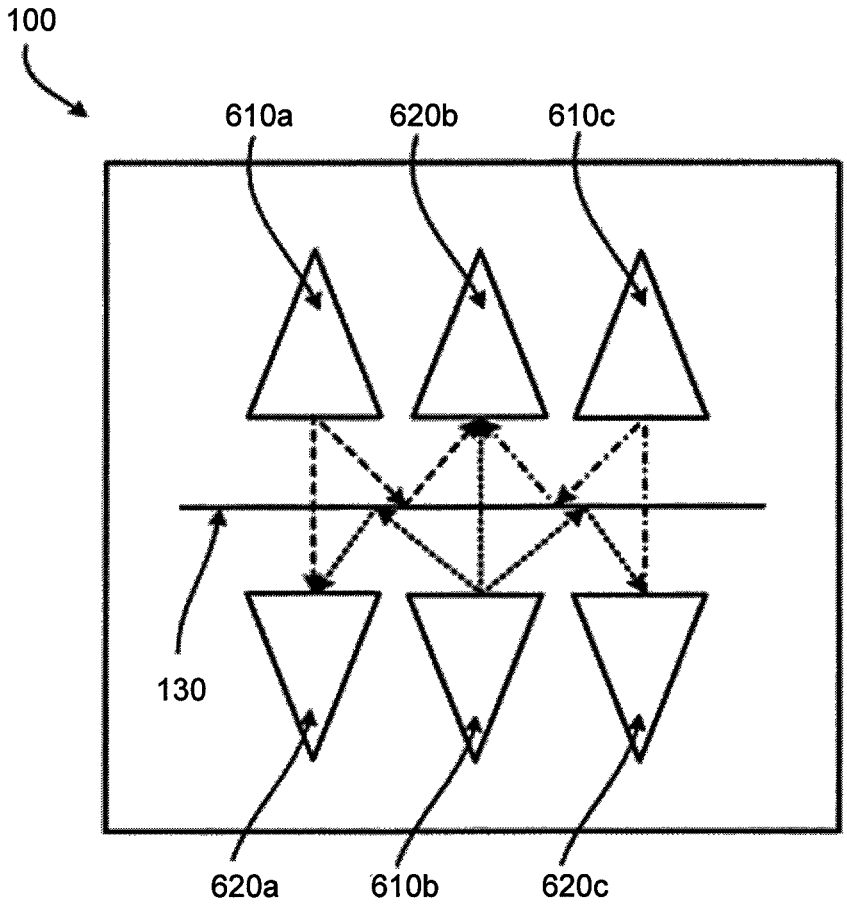
FIG. 7 is a schematic view of the sensor module according to an embodiment.

Optionally, the receiver 520 can also comprise a plurality of receivers, configured to receive light at different wavelengths. Referring to FIG. 7, the plurality of light emitting diodes 610*a*, 610*b*, and 610*c* can be interspersed with the plurality of receivers 620*a*, 620*b*, and 620*c* to facilitate the measurement of both the light transmitted and the light reflected by the item of currency 130.

Figure 8:
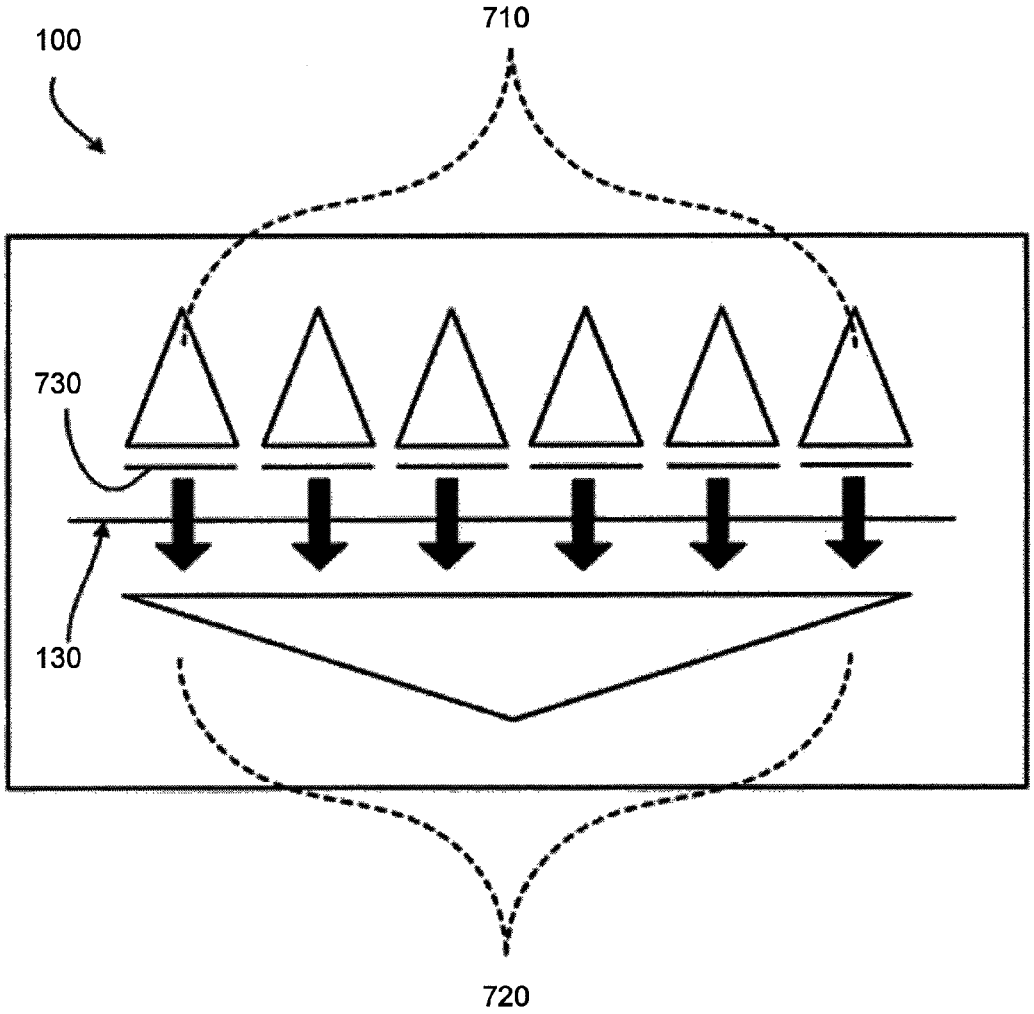
FIG. 8 is a schematic view of the sensor module according to an embodiment.
Figure 9:
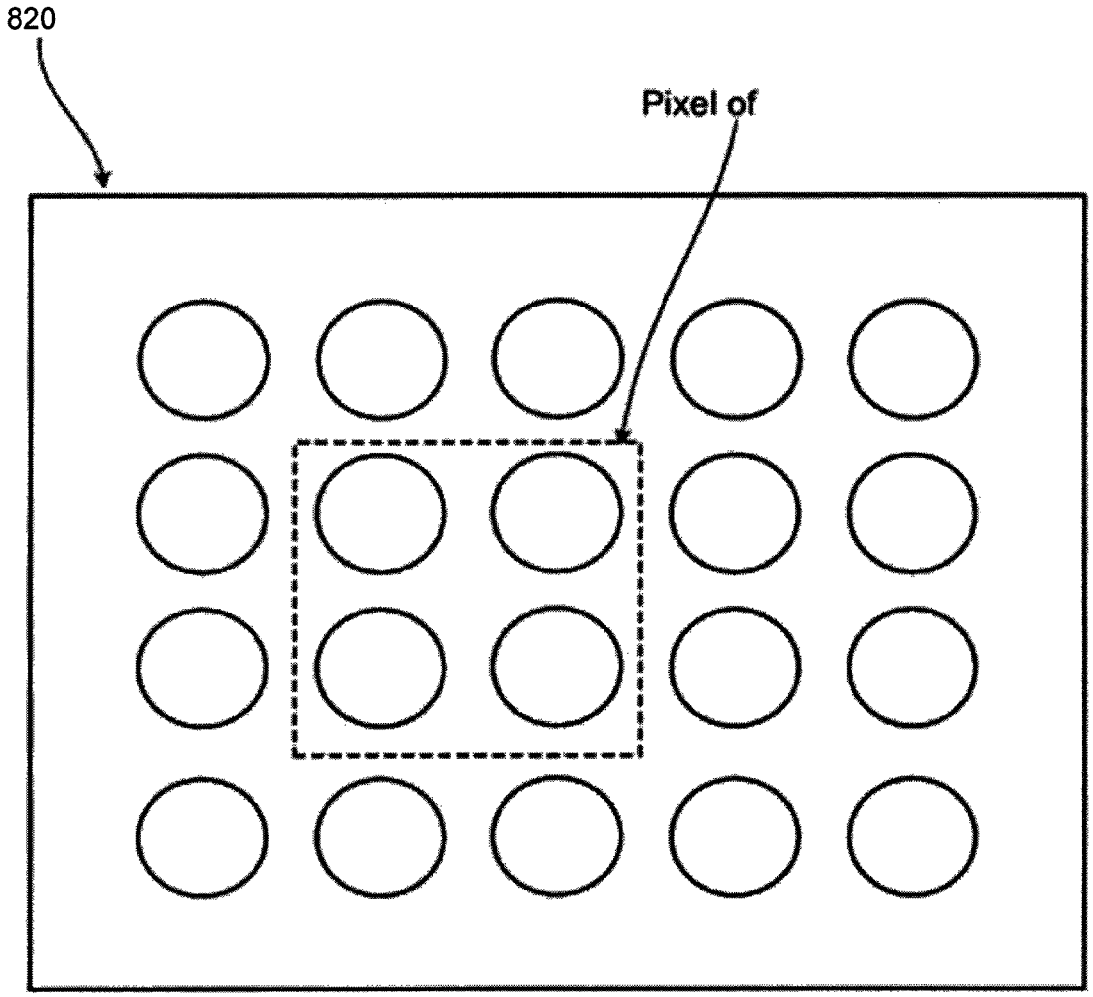
FIG. 9 is a schematic view of the receiver according to an embodiment.

In some implementations, as shown in FIG. 8, the sensor module 100 can include a light source 710, itself comprising a plurality of optical filters 730, configured to filter the light to a band of wavelengths. In this design, the receiver 720 can comprise an image sensor. For example, referring to FIGS. 8 and 9, receiver 820 can comprise an image sensor, itself comprising a plurality of pixels.

Figure 10:
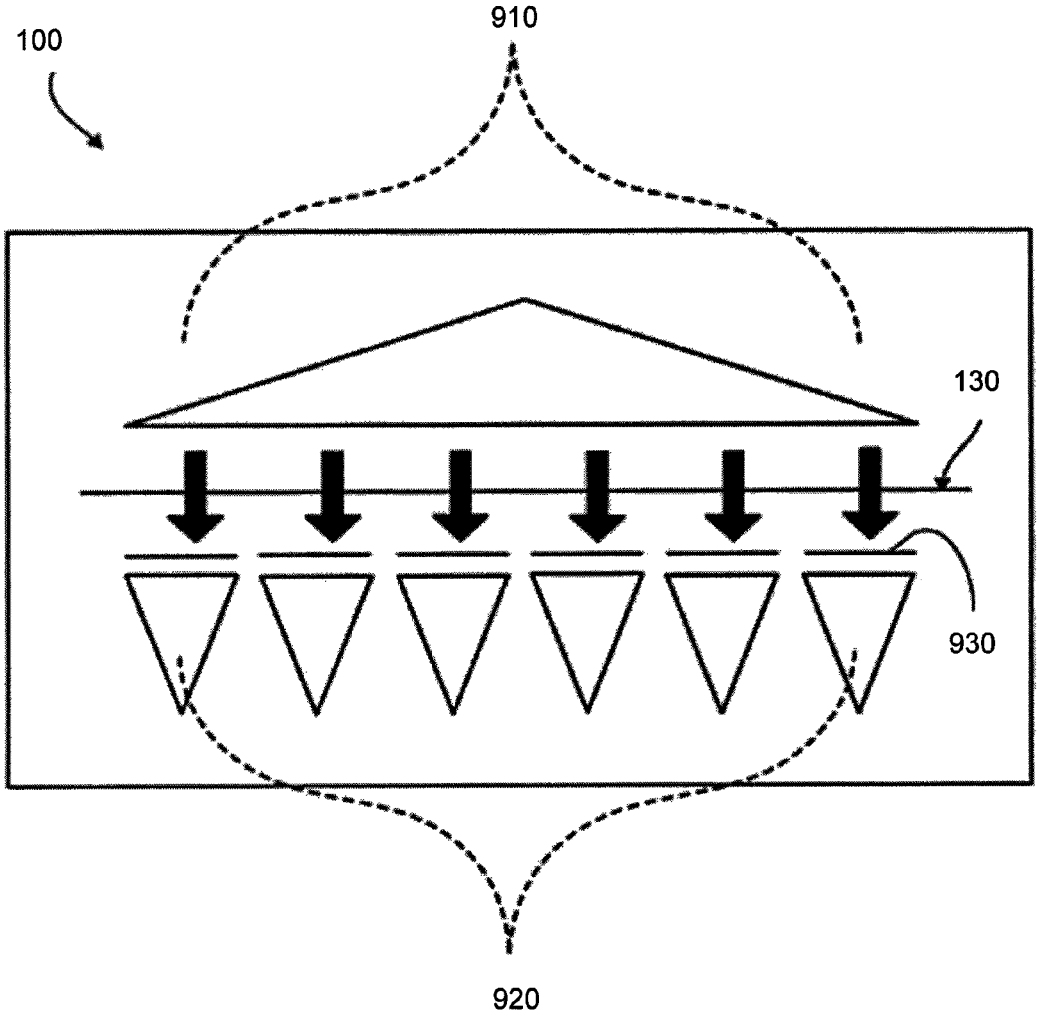
FIG. 10 is a schematic view of the sensor module according to an embodiment.

In some implementations, as shown in FIG. 10, the sensor module 100 can include a light source 910, and a receiver 920 comprising a plurality of photodetectors. In some designs, the receiver 920 can also include a plurality of optical filters 930, configured to filter the light to a band of wavelengths.

Figure 11:
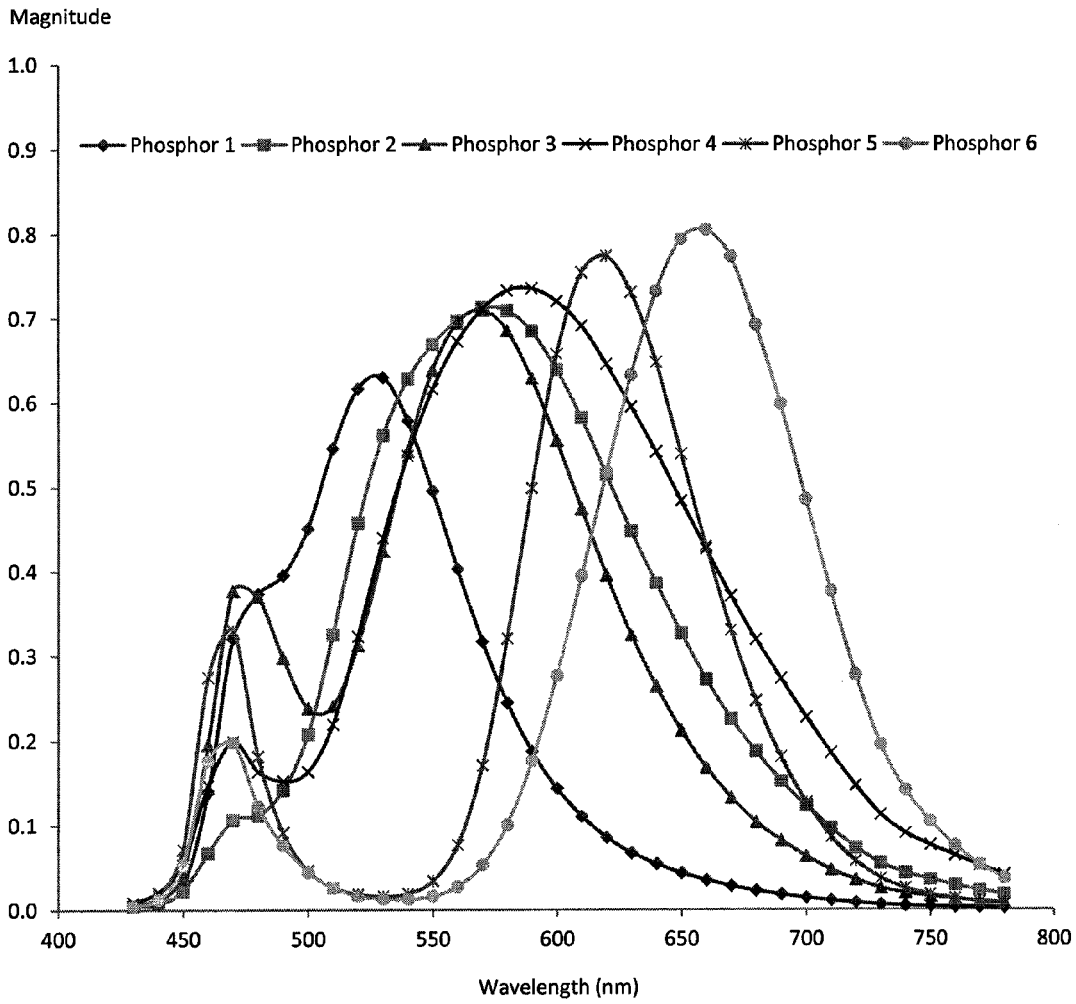
FIG. 11 is a chart illustrating the spectra of a plurality of light emitting diodes according to an embodiment.

In some embodiments, as shown in FIG. 11, the light emitting diode wavelengths can optionally be selected to be linearly independent. As illustrated in the figure, the light emitting diodes can also be selected to minimize coherence with the representation space. In one design, the processor can be configured to control each of the plurality of light emitting diodes independently. In one implementation, each of the plurality of light emitting diodes can be energized in a predetermined manner.

In order to effectuate the application of validation of an item of currency in a validation apparatus employing compressive sensing techniques, a few operations can be performed in a lab, manufacturing facility, or other location separate from the validation apparatus 10.

To perform validation of an item of currency 130 using compressive sensing techniques in a validation apparatus 10, a basis (i.e. a representation matrix) must be defined for transformation between a non-sparse function space and a sparse function space. In some implementations, a basis is learned in the laboratory environment. For example, a learned basis can be a dictionary D for transforming non-sparse measurements Y or spectrum X into a sparse spectrum signal Θ.

Figure 4:
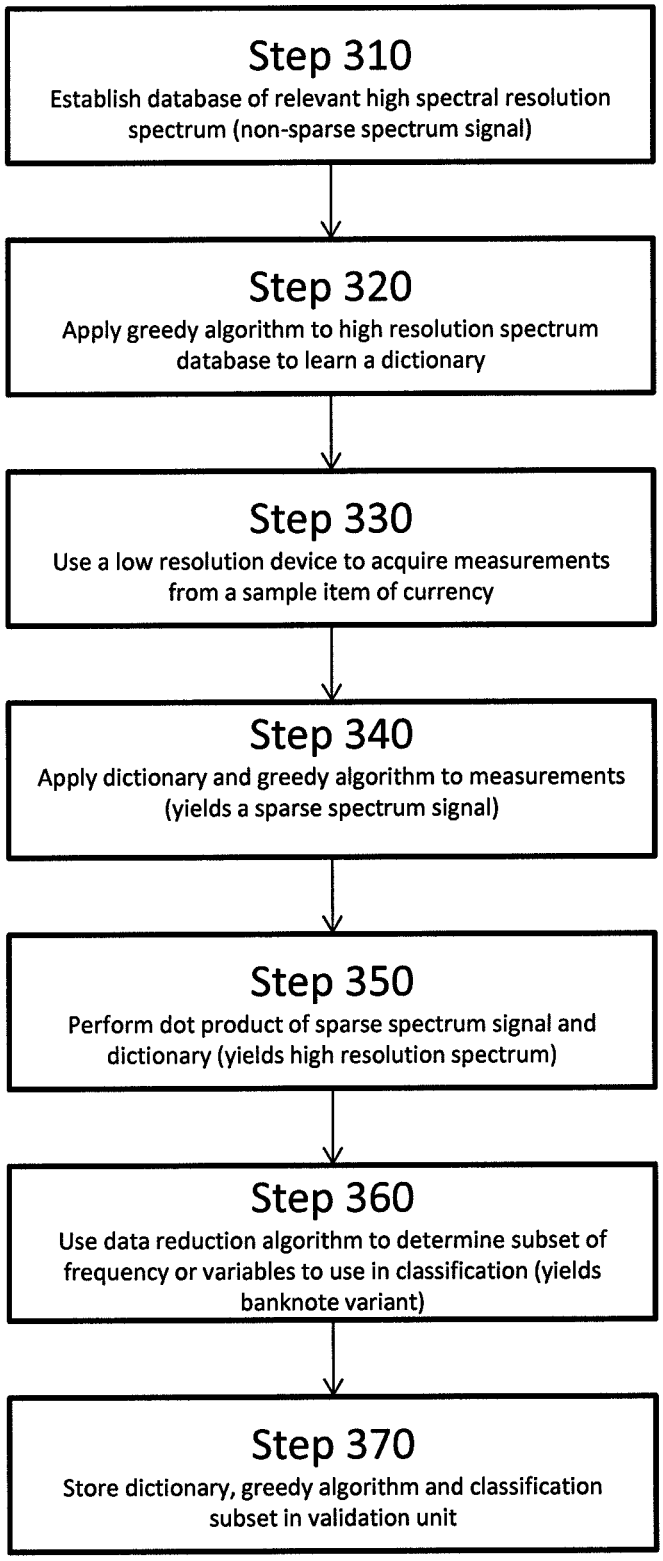
FIG. 4 is a flowchart illustrating the design of a learned dictionary.

In some implementations, a plurality of measurements or spectrum can be obtained using a high spectral resolution measurement device such as a spectrophotometer as shown in step 310 of FIG. 4. This plurality of measurements of spectral content can be stored in a reference database as used for establishing a dictionary D. In some implementations, applying a L1-minimization algorithm (e.g. matching pursuit algorithm) to a database of high spectral resolution measurements Y is used to learn dictionary D as shown in step 320.

Once the dictionary D has been determined in step 320, a low-resolution device (e.g. standard bill validator) can be used to acquire measurements from a sample item of currency 130 as shown in step 330. However, it is to be understood that other devices can be used to acquire measurements from a sample item of currency, such as but not limited to a high-resolution spectrophotometer. In step 340 the dictionary D in conjunction with a L1-minimization algorithm is applied to the measurements Y obtained in step 330. The output of step 340 is the calculation of a sparse spectrum signal Θ of measurements Y. In step 350, the dot product of the sparse spectrum signal Θ and the dictionary D is calculated to attain a high resolution spectrum Z of sparse spectrum signal Θ.

In step 360, a data reduction algorithm (e.g. variable selection, Feature Vector Selection (FVS) (Feature Vector Selection (FVS): is an algorithm described, for example in U.S. Pat. No. 7,648,016), or Support Vector Machine (SVM)) can be used to determine a subset of frequency or variables W for use in a later classification process in a validation unit 10. The data reduction algorithm is used to determine the subset of variables of high resolution spectrum Z that provides the largest separation in a classification process between valid and non-valid items of currency for a given spot or pixel. In step 370, the defined dictionary D, a L1-minimization algorithm, and a subset of classification variables W can be stored (e.g. in memory) in a validation unit 10.

It is important to understand that steps 330-370 can be performed for each desired item of currency 130 that a validation apparatus 10 is configured to validate in the field.

As noted above, in some embodiments, as generally shown in steps 310-370 of FIG. 4, a representation matrix, such as a learned dictionary, can be developed to transition between a non-sparse function space and a sparse function space. The overarching design criteria is to enable the unique identification of a reconstructed spectrum of a signal X from its measurements Y, wherein the sensing matrix $\Phi=(\perp_l, \ldots, \perp_m)$, and Y=>X. The signal of interest $x=\Sigma_{i=1}^{n} A_i\theta_i$, of dimension n, can often be expressed by a linear combination elementary signal $A_i$ called atoms, wherein the coefficient vector >= $(\theta_l, \ldots, \theta_n)$.

Figure 15:
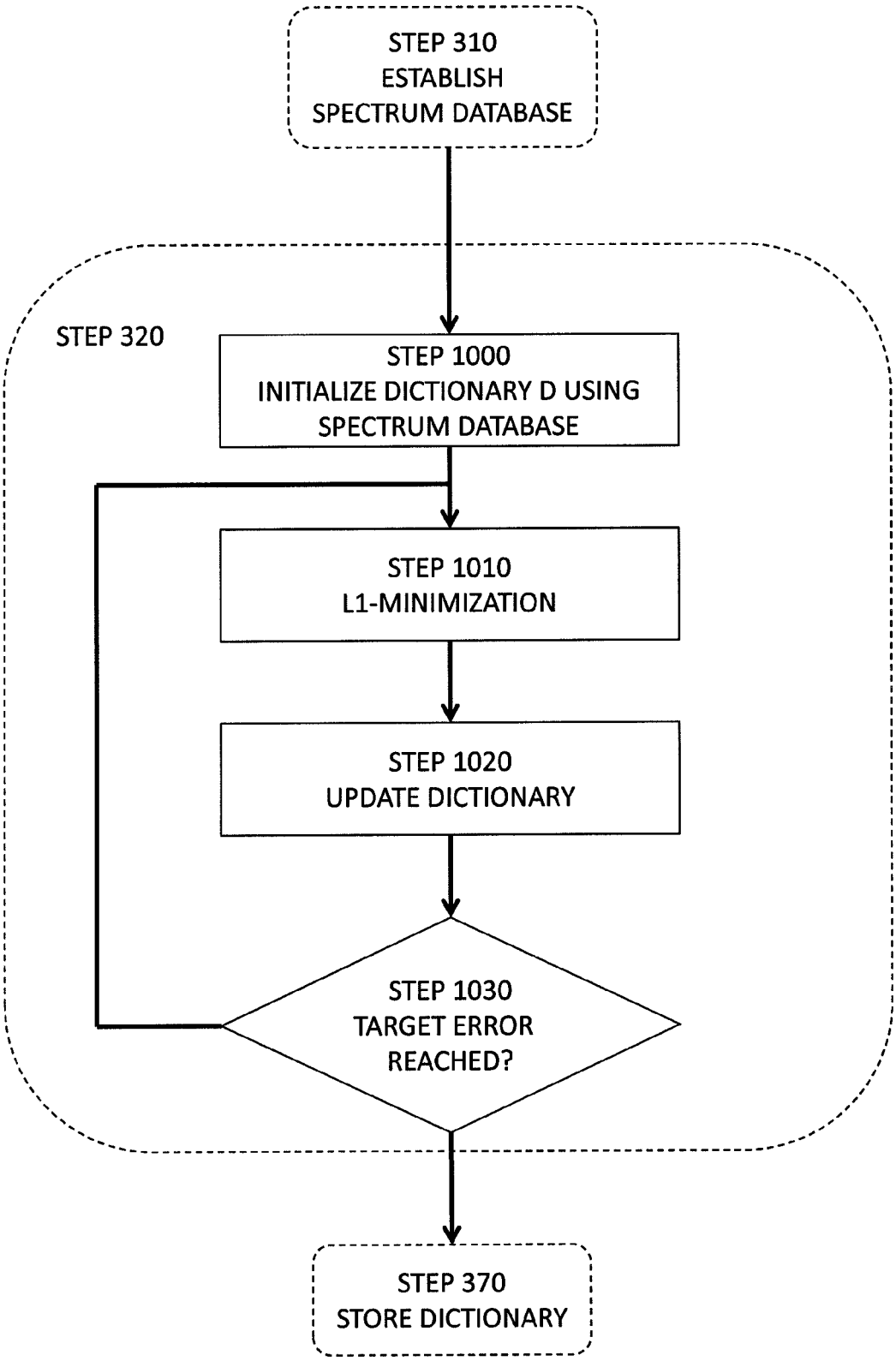
FIG. 15 is a flowchart illustrating an algorithm used to design a representation matrix according to an embodiment.

A plurality of measurements or spectrum can be obtained using a high spectral resolution measurement device such as a spectrophotometer, as generally shown in step 1000 of FIG. 15, can be used to initialize the stored representation matrix.

The sparse representation Θ can be designed by alternating between two steps of estimation, and maximization, until a fixed target error is reached.

In some embodiments, as shown in step 1010, the estimation can be carried out by executing an L I-minimization algorithm on a dictionary. For example, after the dictionary D is initialized the L 1-minimization algorithm can be executed according to the following constraint:

$$\min_{\Theta} \|\Theta\|_{L_1} \quad s.t. \|Y-\Phi\hat{D}\Theta\|_F<\varepsilon \qquad \text{(equation 2)}$$

Such an algorithm, as described in equation 2, that is based upon L1-minimization can be solved using a number of different techniques, including but not limited to, using convex optimization, greedy algorithms, or any combination thereof.

For example, in equation 2, a sparse signal, $\Theta=(\theta_l, \ldots, \theta_n)$, can be found by using a greedy algorithm which iteratively relaxes the sparsity constraints, subject to the constraint that the reconstruction error, expressed as a Frobenius norm, $\|Y-\Phi\hat{D}\theta\|_F$, must be minimized to a fixed target error, M.

Greedy algorithms, such as but not limited to, matching pursuit algorithms can solve this problem by successively adding new atoms into a sparse approximation $A_i\theta_i$ with the objective of minimizing the $i^{th}$ residual: $r_i=\theta-A_i\theta_i$, where $A_i$ is the $i^{th}$ atom of the representation matrix. However, it should be understood that other greedy algorithms can be used to solve this problem, such as, but not limited to orthogonal matching pursuit, method of optimal direction, thresholding algorithms, or any combination thereof.

Figure 16:
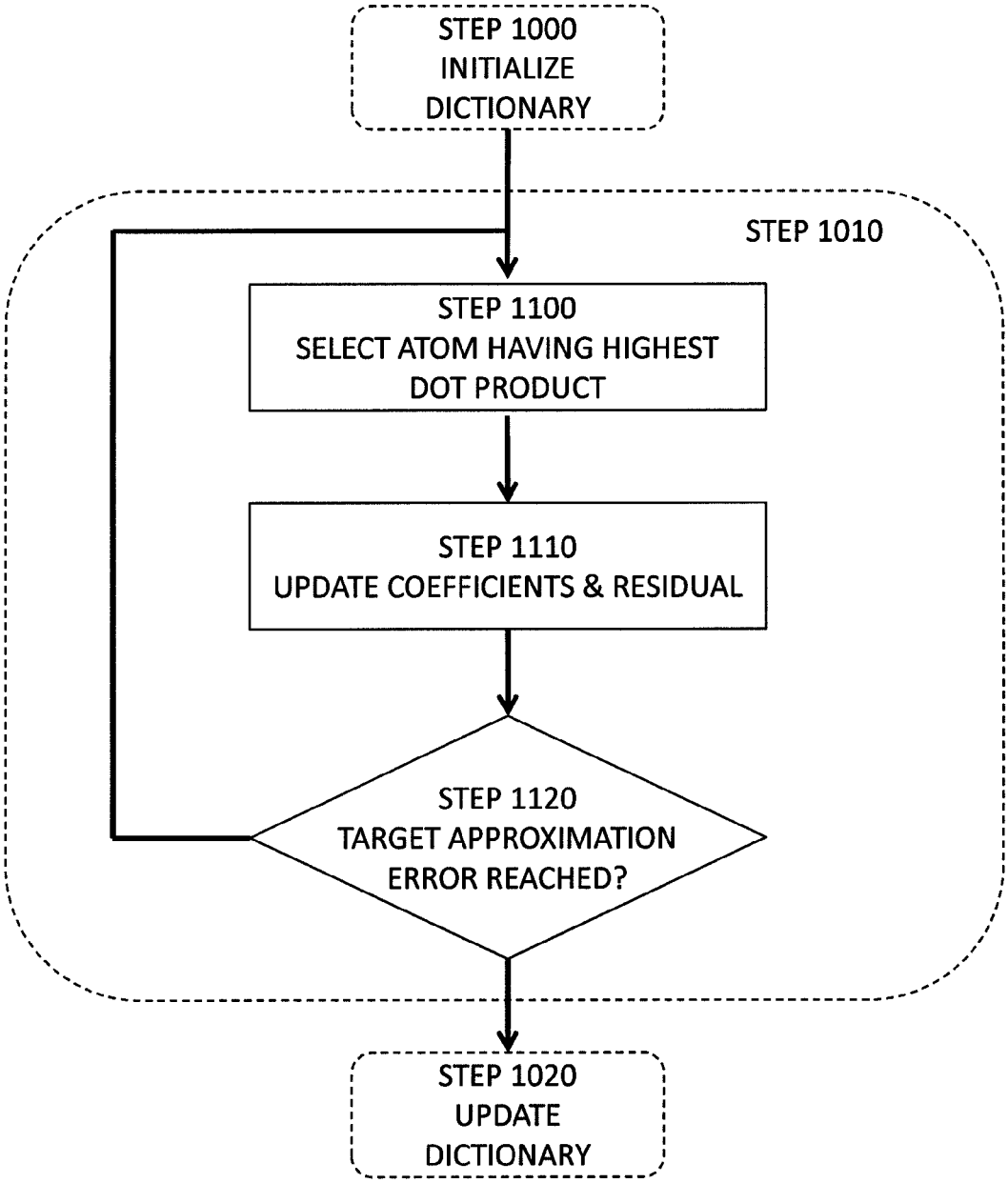
FIG. 16 is a flowchart illustrating an L1-minimization algorithm according to an embodiment.

Each iteration of the greedy algorithm, as shown in FIG. 16, can comprise steps 1100 and 1110. In step 1100, an atom having the highest dot product with the residual can be found and subsequently added to the selected atoms according to the following equation:

$$\theta_i=\text{argmax}_{\theta\in A}|\langle r_{i-1}|\theta\rangle| \qquad \text{(equation 3)}$$

In step 1110, the coefficients $\theta_i$ and the residual $r_i$ are updated according to the following matching pursuit or orthogonal matching pursuit rules:

$$r_i = r_{i-1} - \langle A_i \rangle A_i \quad \text{(equation 4)}$$

$$r_i = r_{i-1} - A_i(A_i^t A_i)^{-1} A_i^t r_{i-1} \quad \text{(equation 5)}$$

Thus, in step 1120, the new approximation error $\|r_i\|_{L_2}$ expressed as an $L_2$ norm, can be minimized. Referring back to FIG. 15, in step 1020, an updated dictionary Dis then found which minimizes the Frobenius norm according to the following equation:

$$\min_D \|X - D\hat{\Theta}\|_F \quad \text{(equation 6)}$$

FIG. 15 illustrates an exemplary method of L1-minimization, step 1010, using a matching pursuit algorithm, steps 1100-1120, to find a sparse coefficient vector, 1, that minimizes the reconstruction error. It should be clear to a person of ordinary skill in the art that other methods can be used to minimize the reconstruction error without departing from the spirit and scope of the present disclosure. For example, many different algorithms, such as but not limited to, algorithms based upon L1-minimization or other greedy algorithms, thresholding algorithms, method of optimal direction, or any combination thereof can be used to minimize the reconstruction error.

Once the representation matrix is designed, it can be stored. Referring back to FIG. 15, in step 370, the representation matrix is stored.

The validation apparatus and methods described herein are illustrative in nature and are not meant to be limiting in any way. Those of skill in the art will appreciate variations which do not deviate from the scope and spirit of the disclosure herein, which are encompassed by this disclosure.

What is claimed is:

1. A validation apparatus comprising:

a light source capable of emitting a broadband spectrum of light for illuminating an item of currency;

a receiver configured to receive light emitted from the light source and obtain spectral measurements of the inserted item of currency, wherein the received light comprises at least a portion of light reflected by or transmitted through the item of currency;

a transportation unit configured to transport the item of currency within the validation apparatus; and a processor configured to reconstruct a spectral response of the item of currency by transitioning the spectral measurements of the inserted item of currency from a non-sparse function space to a sparse function space using a learned dictionary, the learned dictionary designed by estimating a sparse signal that minimizes a reconstruction error and updating the learned dictionary using the estimated sparse signal.

2. The apparatus of claim 1 further comprising stored classification variables.

3. The apparatus of claim 1 wherein the light source emits light in one or more of the visible and non-visible light spectrum.

4. The apparatus of claim 1 wherein the receiver comprises:

a broadband photodetector;

an optical filter array coupled to the photodetector, the optical filter array comprising a plurality of optical filters configured to filter light at different wavelengths;

wherein the processor is configured to selectively control an optical filter for coupling with the photodetector.

5. The apparatus of claim 1 wherein the receiver comprises a plurality or broadband photodetectors, wherein each photodetector is configured to filter light at different wavelengths.

6. The apparatus of claim 1 wherein the light source comprises a plurality of light emitting diodes configured to emit light at different wavelengths.

7. The apparatus of claim 6 wherein the different wavelengths are linearly independent.

8. The apparatus of claim 6 wherein the light-emitting diode wavelengths are selected to minimize a coherence.

9. The apparatus of claim 6 wherein the plurality of light emitting diodes comprises a blue LED, wherein phosphors are used to control a spectral emission of the blue LED.

10. The apparatus of claim 6 wherein the plurality of light emitting diodes comprises an ultraviolet LED, wherein phosphors are used to control a spectral emission of the ultraviolet LED.

11. The apparatus of claim 6 wherein the plurality of light emitting diodes comprises an infrared LED.

12. The apparatus of claim 6 wherein the light source comprises at least three light emitting diodes configured to emit light at different wavelengths.

13. The apparatus of claim 6 wherein the light source comprises at least six light emitting diodes configured to emit light at different wavelengths.

14. The apparatus of claim 6 wherein the processor is further configured to control each of the plurality of light emitting diodes independently.

15. The apparatus of claim 6 wherein each of the plurality of light emitting diodes is energized in a predetermined manner.

16. The apparatus of claim 1 further comprising a stored L1-minimization algorithm.

17. The apparatus of claim 16 wherein the L1-minimization algorithm comprises a greedy algorithm.

18. The apparatus of claim 1 wherein the processor is further configured to:

apply acceptance criteria to the reconstructed spectral response to determine whether the item of currency falls within a predetermined classification of currency;

wherein the spectral response is reconstructed based upon the learned dictionary and the obtained spectral measurements of the inserted item of currency.

19. A method of validating an item of currency comprising the steps of:

transporting the item of currency within the validation apparatus;

emitting a broadband spectrum of light to illuminate the item of currency in at least one spot;

receiving at least a portion of the light reflected by or transmitted through the item of currency emitted from the light source to obtain spectral measurements of the inserted item of currency; and reconstructing via a processor a spectral response of the item of currency by transitioning the spectral measurements of the inserted item of currency from a non-sparse function space to a sparse function space using a learned dictionary, the learned dictionary designed by estimating a sparse signal that minimizes a reconstruction error and updating the learned dictionary using the estimated sparse signal.

20. The method of claim 19 wherein light is emitted in one or more of the visible and non-visible light spectrum.

21. The method of claim 19 wherein the receiver comprises:

a broadband photodetector;

an optical filter array coupled to the photodetector, the optical filter array comprising a plurality of optical filters configured to filter light at different wavelengths;

wherein the processor is configured to selectively control an optical filter for coupling with the photodetector.

22. The method of claim 19 further comprising the step of storing a L1-minimization algorithm.

23. The method of claim 19 further comprising the step of storing classification variables.

24. The method of claim 19 wherein the light is emitted using a light source comprising a plurality of light emitting diodes configured to emit light at different wavelengths.

25. The method of claim 24 wherein the different wavelengths are linearly independent.

26. The method of claim 24 wherein the light-emitting diodes are selected to minimize a coherence with the representation space.

27. The method of claim 24 wherein the plurality of light emitting diodes comprises a blue LED, wherein phosphors are used to control a spectral emission of the blue LED.

28. The method of claim 24 wherein the plurality of light emitting diodes comprises an ultraviolet LED, wherein phosphors are used to control a spectral emission of the ultraviolet LED.

29. The method of claim 24 wherein the plurality of light emitting diodes comprises an infrared LED.

30. The method of claim 24 wherein the plurality of light emitting diodes includes at least three light emitting diodes.

31. The method of claim 24 wherein the plurality of light emitting diodes includes at least six light emitting diodes.

32. The method of claim 24 wherein the processor is further configured to carry out the step of controlling each of the plurality of light emitting diodes independently.

33. The method of claim 24 wherein each of the plurality of light emitting diodes is energized in a predetermined manner.

34. The method of claim 19 further comprising the step of storing a learned dictionary that is used to transition from a non-sparse function space to a sparse function space.

35. The method of claim 34 wherein the processor is further configured to carry out the steps of:

applying acceptance criteria to the reconstructed spectral response to determine whether the item of currency falls within a predetermined classification of currency;

wherein the spectral response is reconstructed based upon the stored learned dictionary and the obtained spectral measurements of the inserted item of currency.

36. The apparatus of claim 1, wherein estimating the sparse signal includes iteratively relaxing sparsity constraints of the sparse signal.

37. The apparatus of claim 36, wherein reconstructing the spectral response is a dot product of the learned dictionary and the spectral measurements transitioned into a sparse function space.

38. The method of claim 19, wherein estimating the sparse signal includes iteratively relaxing sparsity constraints of the sparse signal.

39. The method of claim 38, wherein reconstructing the spectral response is a dot product of the learned dictionary and the spectral measurements transitioned into a sparse function space.

* * * * *